United States Patent [19]

Palmer, III et al.

[11] Patent Number: 4,735,585

[45] Date of Patent: Apr. 5, 1988

[54] INTERPLANE CONNECTOR

[75] Inventors: Ransom C. Palmer, III, Bridgewater, N.J.; George Keremedjiev, Doylestown, Pa.

[73] Assignee: United Stamping and Assembly, Inc., Maplewood, N.J.

[21] Appl. No.: 39,241

[22] Filed: Apr. 17, 1987

[51] Int. Cl.[4] ..... H01R 13/424

[52] U.S. Cl. ..... 439/701; 29/758; 29/764; 439/752

[58] Field of Search ..... 29/758, 764; 439/74, 439/75, 701, 731, 733, 752

[56] References Cited

U.S. PATENT DOCUMENTS

| | | | |
|---|---|---|---|
| 3,273,107 | 9/1966 | Chandler | 439/733 |
| 3,569,917 | 3/1971 | Gilissen | 439/752 |
| 3,896,535 | 7/1975 | Tucci | 29/758 |
| 4,295,703 | 10/1981 | Osborne | 439/752 |
| 4,380,118 | 4/1983 | Driver et al. | 29/758 |
| 4,387,950 | 6/1983 | Guzik | 439/752 |

OTHER PUBLICATIONS

IBM Technical Disclosure Bulletin, vol. 24, No. 11B, Apr. 1982 "Cable Housing Insertion and Extraction Device.

*Primary Examiner*—John McQuade
*Attorney, Agent, or Firm*—Blum Kaplan

[57] ABSTRACT

An interplane connector assembly for permitting in situ replacement of dual beam compliant contacts that are damaged or non-functional is provided. The interplane connector includes a support for receiving therein at least one row of dual beam compliant contacts and a cover. The cover is adapted to be releasably secured to the support and includes projecting stops that are displaced through a space between dual beams of the contact and received in an opening in the support that is disposed in alignment with the space between the dual beams so that the contact cannot be displaced from the support during insertion of the contact into a circuit board but yet so the contact can be removed and replaced when the cover is removed from the support.

14 Claims, 5 Drawing Sheets

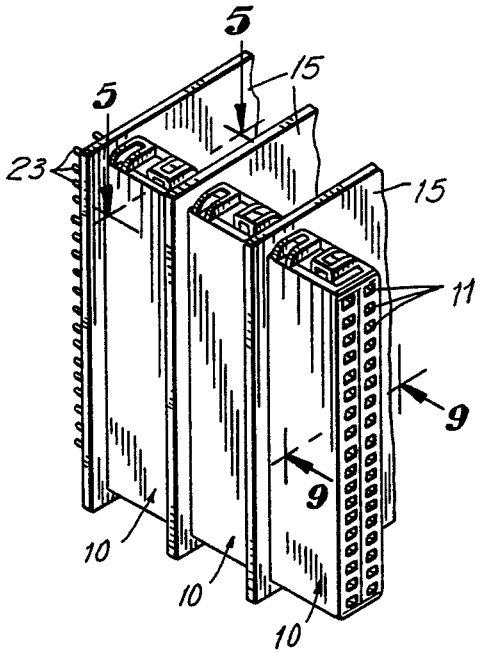
FIG. 1
FIG. 3
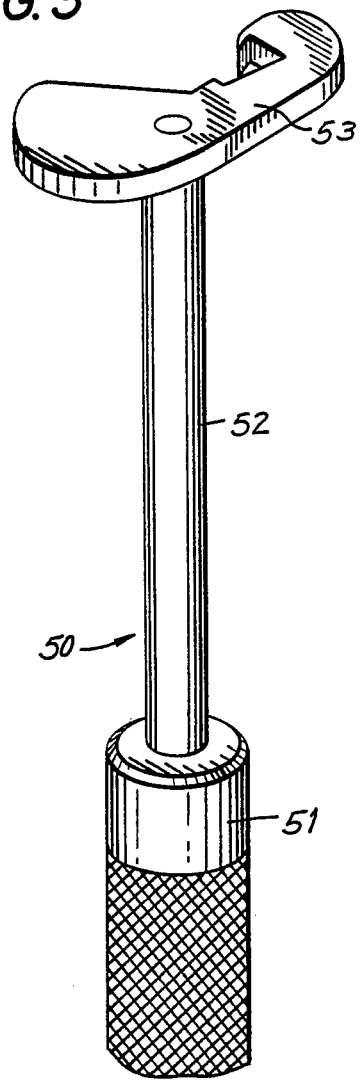
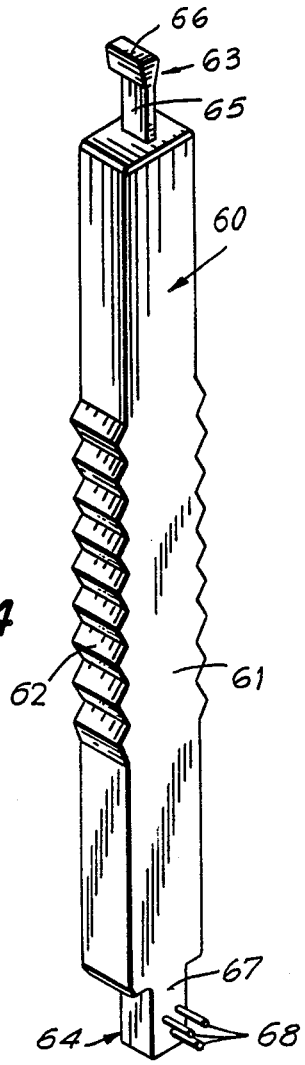
FIG. 4

10
11
12
20
21
23
24
25
26
27
30
31
33
34
35
36
37
40
41
43
44
45

11
12
23
23
27
27
43
44
44
25
25
26
26
33
68
68
68
67
64
60
11

40
21
31
45
20
25
30
37
25
31
43
21
25
45

23
27
12
25
33
68
26
B
67
64
60

INTERPLANE CONNECTOR

BACKGROUND OF THE INVENTION

This invention relates generally to an interplane connector for use in mounting, connecting and stacking of printed circuit boards and, in particular, to an interplane connector assembly that permits dual beam compliant contacts to be releasably mounted and positioned therein.

Heretofore, interplane connectors have been utilized to mount an array of stacked circuit boards. The interplane connectors house dual beam complaint contacts wherein the mating force necessary to obtain a proper insertion of the contact tail into an integrated circuit board or, if necessary, into an intergrated circuit board and a further hermaphroditic interplane connector is on the order of 3 to 6 pounds per contact per position. Accordingly, the mating forces against the array of contacts normally is on the order of 300 pounds during insertion of a connector during assembly. Moreover, this process aften causes the contact to be damaged and rendered non-functional.

Once a contact tail is damaged or no longer functional, either the entire connector assembly is replaced or in some instances efforts have been made to replace a single contact. However, such efforts to replace the contact degrades the integrity of the contact-housing interface and results in a replacement contact that is inferior to the originally mounted contacts. Accordingly, an interplane connector assembly that permits circuit boards to be efficiently and effectively stacked, mounted and connected and yet permits in situ replacement of an individual dual beam compliant contact is desired.

SUMMARY OF THE INVENTION

Generally speaking, in accordance with the invention, an interplane connector assembly for releasably mounting and positioning a plurality of dual beam compliant contacts is provided. A support is configured to receive therein at least one row of dual beam compliant contacts in a manner that permits the tail of the contact to extend therefrom when each complaint contact is fully inserted therein. The support includes a plurality of openings, each opening being disposed in alignment with the space that is formed in the compliant contact between the dual beams when the compliant contact is fully inserted into the support. A cover is adapted to be releasably secured to the support and includes a row of stops projecting therefrom. The stops are adapted to pass through the space between the dual beams of the complaint contact and into the aligned opening in the support when the cover means is releasably secured to the support, so that the compliant contacts are prevented from being displaced from the support when mating forces are applied against the tail of the contact and further so that each of the compliant contacts can be selectively removed from the support when the cover sheet is removed from the support.

It is therefore an object of the invention to provide an improved interplane connector assembly.

It is a further object of the invention to provide an interplane connector assembly that permits in situ replacement of a dual beam compliant contact.

A further object of the instant invention is to provide an improved interplane connector assembly and appliances for use therewith that facilitate removal and replacement of non-functional or damaged dual compliant contacts.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a perspective view of an array of interplane connector assemblies constructed in accordance with a preferred embodiment of the instant invention;

FIG. 3 is a partial perspective view of a cover removal tool used with the interplane connector of the instant invention;

FIG. 4 is a perspective view of a compliant pin replacement tool for use with the interplane connector assembly of the instant invention;

DETAILED DESCRIPTION OF THE PREFERRED EMBODIMENTS

Figure 2:
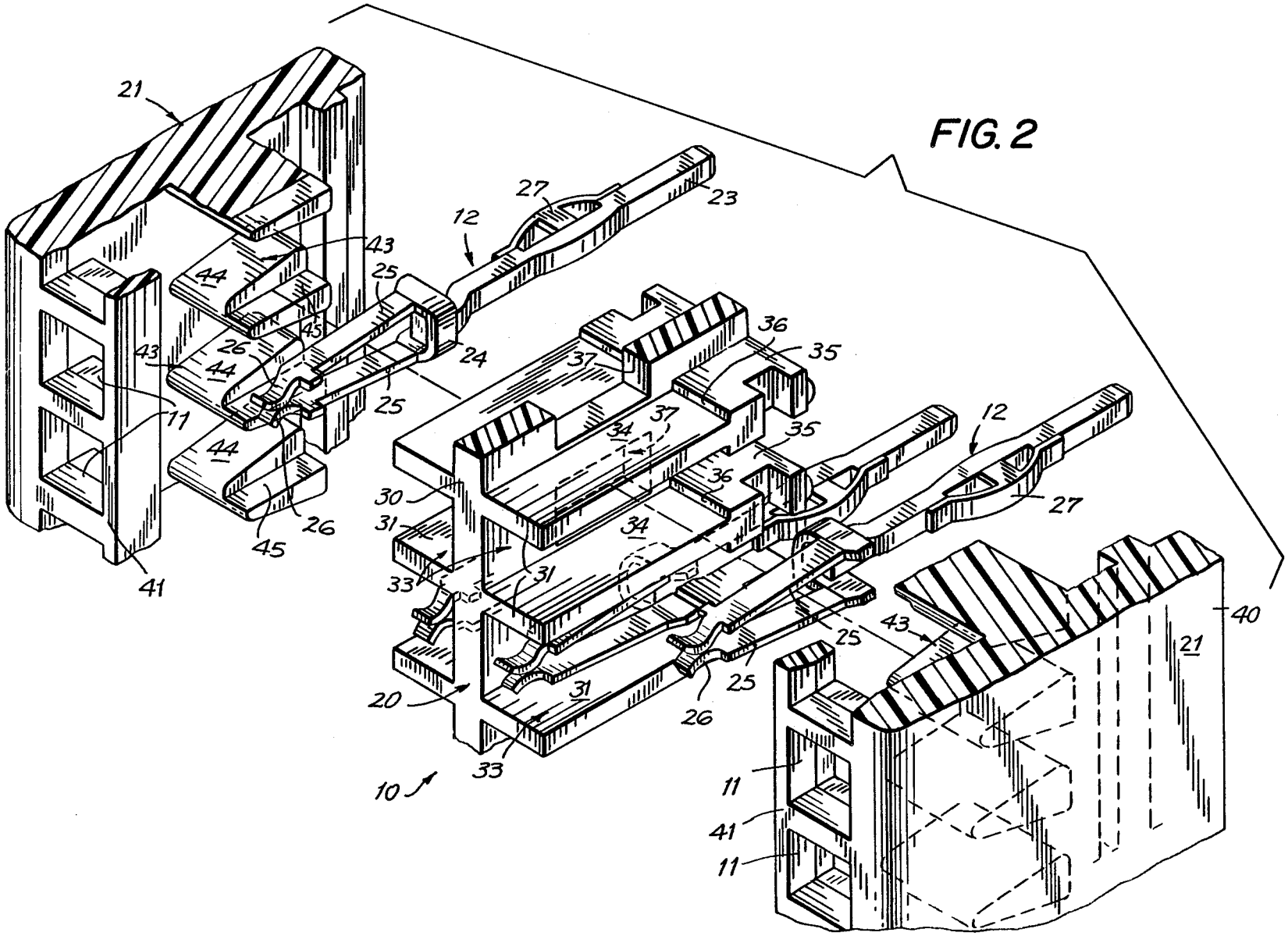
FIG. 2 is an exploded fragmentary perspective view of the interplane connector assembly of the instant invention.

Reference is made to FIGS. 1 and 2 wherein an interplane connector assembly, generally indicated as 10, is illustrated. Each interplane connector 10 houses a plurality of dual beam compliant contacts, generally indicated as 12, each having a 0.025 square tail. Dual beam compliant contacts are well known in the art. Although this application is described for use with dual beam compliant contacts, it is equally applicable to any type of hermaphrodite type contact that mates with itself and is conventionally used in circuit boards and circuit board applications.

Specifically, each interplane connector assembly 10 includes two rows of openings 11 for receiving contact tails 23 projecting from the interplane connector assembly. Furthermore, each of the contact tails 23 are inserted through openings 13 (FIG. 5) in printed circuit boards 15, which circuit boards have leads 16 printed thereon. The manner in which circuit boards and interplane connectors form an array of hermaphordite type connectors is conventional in the art.

However, as is well known in the art, when an array of circuit boards are connected, in the manner illustrated in FIG. 1, the force applied to each contact is 3 to 6 pounds per tail per position, which force when totaled is on the order of 300 pounds. Accordingly, in order to insert the interplane connector through the openings in the printed circuit board 15 and into a hermaphorditic mating connector, a force on the order of 300 pounds will normally be required to complete the assembly thereof. Such mating forces along with manufacturing alignment problems, often cause contacts to be damaged and rendered non-functional during assembly.

Figure 5:
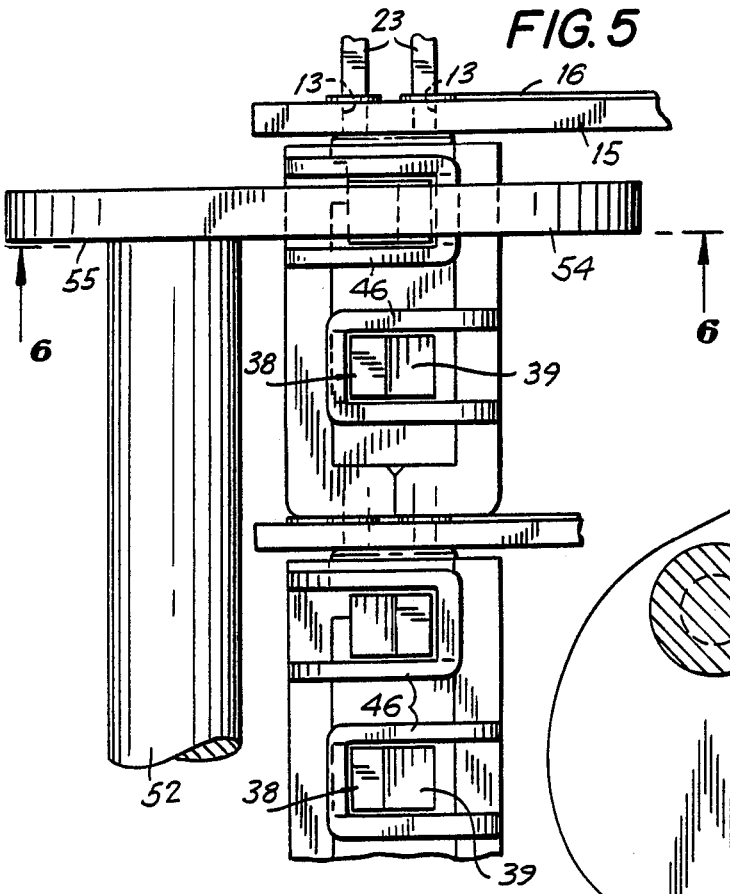
FIG. 5 is a partial plan view taken along line 5—5 of FIG. 1.

Accordingly, referring to FIGS. 1, 2, 8, 9 and 10, each interplane connector assembly 10 of the instant invention includes an I-beam support 20, two covers 21 and compliant contacts, generally indicated as 12. Each compliant contact 12 is formed of resilient spring steel or any other suitable resilient conductive material and includes a contact tail 23 secured to a collar 24. Collar 24, in turn, supports dual beams 25, which beams have bends 26 at the distal ends thereof. The dual beams 25 are resiliently biased so that bends 26 are disposed into touching contact with each other. Tail 23 includes a spring member 27, which spring member is adapted to insure mating of the lead when it is inserted into opening 13 of the circuit boards (FIG. 5). Dual beams 25 define a space therebetween and is adapted to receive between the bends 26 a tail 23 when an interplane connector assembly is stacked in an array, in the manner illustrated in FIG. 1.

Figure 8:
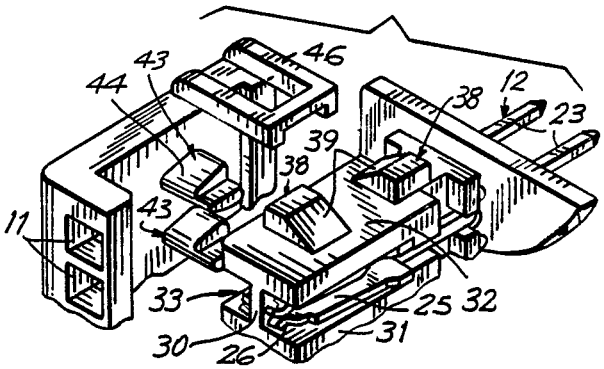
FIG. 8 is a fragmentary exploded view illustrating the manner in which the components of the interplane connector assembly are releasably secured together.

I-beam support 20 includes an elongated center beam 30 supporting a plurality of laterally projecting walls 31 and a pair of end walls 32 (FIG. 8). End walls 31 and projecting walls 32 together with center beam 30 define two rows of receiving slots 33. Each receiving slot 33 includes a wide recess 34, a narrow recess 35 and a step 36.

Figures 9, 10, 11:
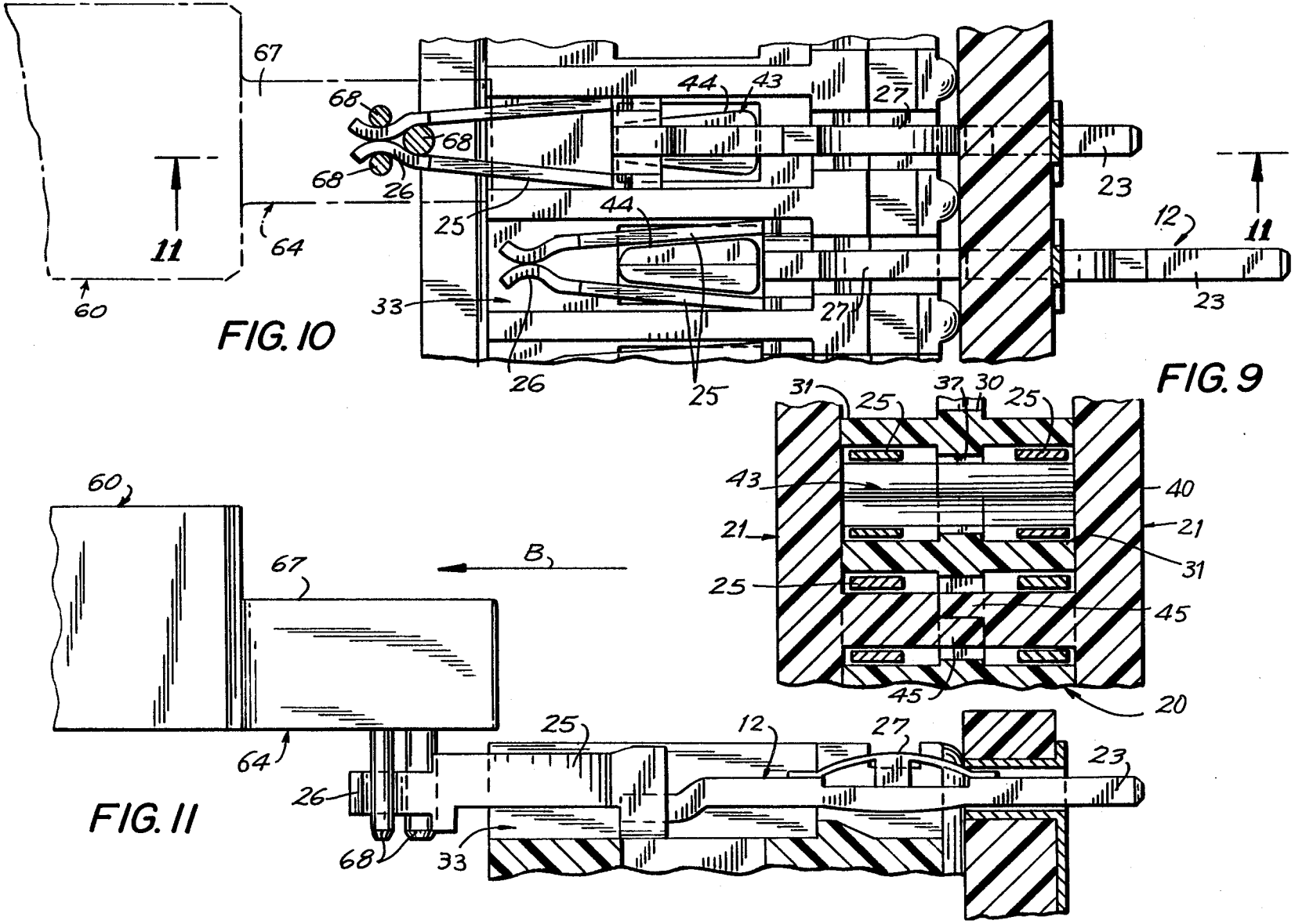
FIG. 9 is a sectional view taken along line 9—9 of FIG. 1.
FIG. 10 is an illustration of the operation of the tool illustrated in FIG. 4.
FIG. 11 is a sectional view taken along line 11—11 of FIG. 10.
Figure 12:
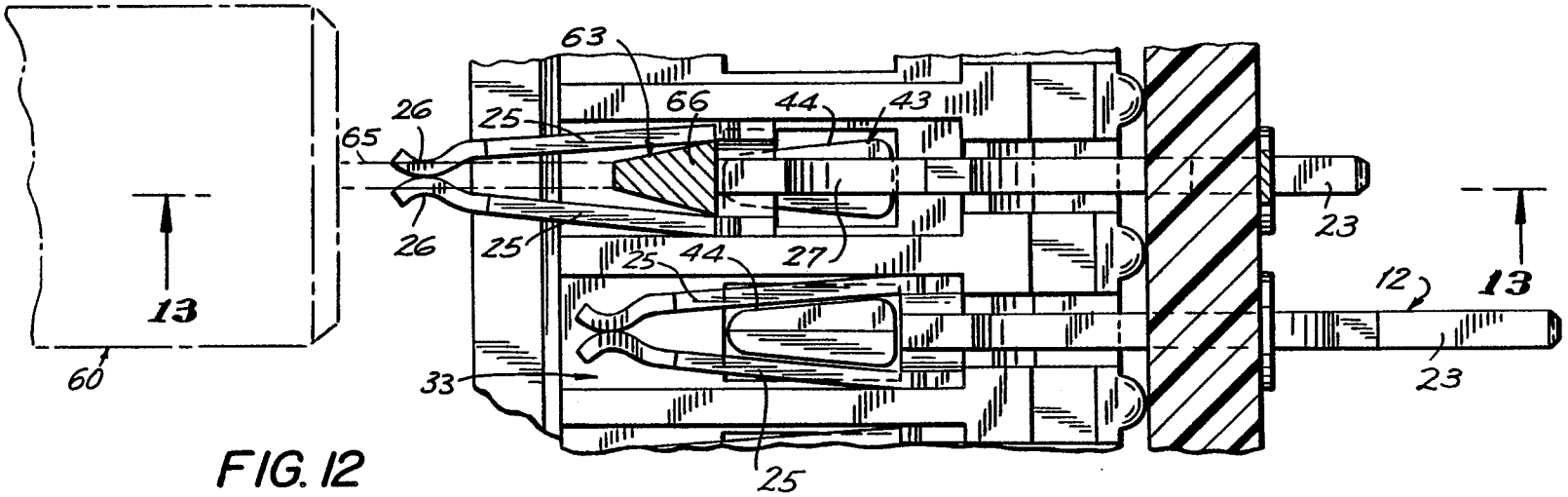
FIG. 12 illustrates the manner in which the tool illustrated in FIG. 4 removes a compliant pin from the interplane connector assembly.
Figure 13:
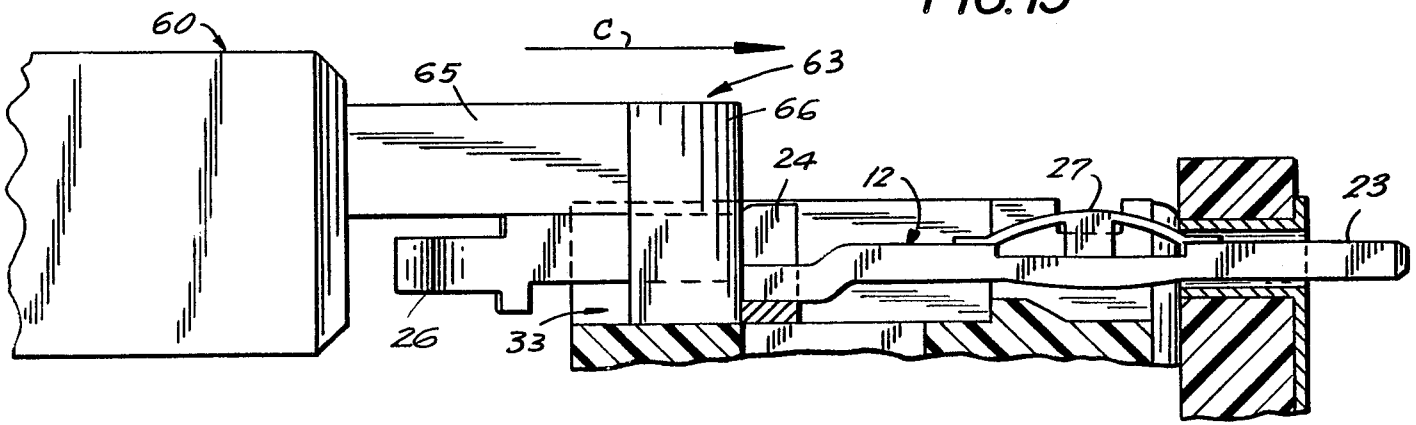
FIG. 13 is a sectional view taken along line 13—13 of FIG. 12 illustrating the manner in which the compliant pin can be reinserted into the interplane connector assembly of the instant invention.

As is illustrated with particularity in FIGS. 8, 10 and 12, each compliant pin 22 is received in the receiving slot 33 so that the dual beams 25 are fully inserted within the slot and so that tail 12 is projecting from the I-beam support. A plurality of openings are formed in the center beam 30 and each opening is disposed in alignment with the space between dual beams 25 of each compliant contact 22, when the compliant contact is fully inserted into receiving slot 33.

Each end wall 32 includes two oppositely disposed cover receiving projections 38. Cover receiving projections 38 include a camming surface 39 and permits the covers to be releasably secured to the I-beam support 20 in a manner to be discussed with greater particularity below.

Covers 21 include an elongated side wall 40, a top wall 41 having a plurality of lead receiving openings 11 formed therein. Projecting inwardly from side wall 40 are a row of projecting stops 43, which stops include a full stop projection 44 which steps down to a half stop projection 45. Closure loops 46 are intergrally formed at the respective ends of wall 40 and are adapted to receive therein projections 38 disposed on end wall 32 of I-beam support 20. As illustrated in FIGS. 1 and 5, covers 21 are secured to I-beam support 20 by inserting closure loop 46 over the camming surface 39 of projection 38. The opposed projections 38 are captured within the closure loop 46 thereby securing the cover 21 to the I-beam support 20.

As illustrated in FIG. 9, when the cover plates are secured to the I-beam support by the closure loops, projecting stops 43 pass through the space formed between dual beams 25 and are inserted into the opening 37 in the I-beam support wall. Specifically, by using projection stops 43, half stop projection 45 extends into opening 37 and mates with the other half of the opposing half stop projection 45 in the opening 37 in the opposed cover plate. Accordingly, by passing the half stop projections 42 of projection stops 43 into the opening 37 and, hence, through the space between the dual beams 25 of each of the compliant contacts, the projecting stops 43 prevent the compliant contacts from being displaced when the mating pressures are applied to the contacts during insertion of the compliant contacts into an integrated circuit board and, if appropriate, into the receiving openings 11 of another interplane connector.

Figure 6:
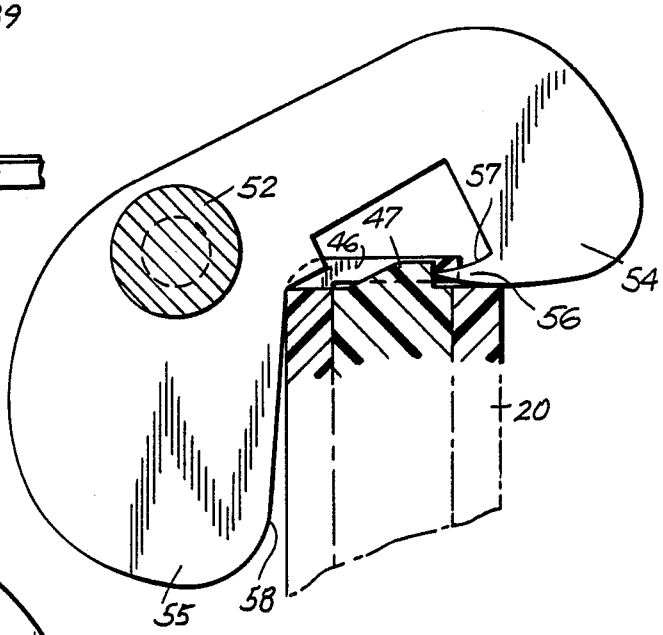
FIG. 6 is a sectional view taken along line 6—6 of FIG. 5.
Figure 7:
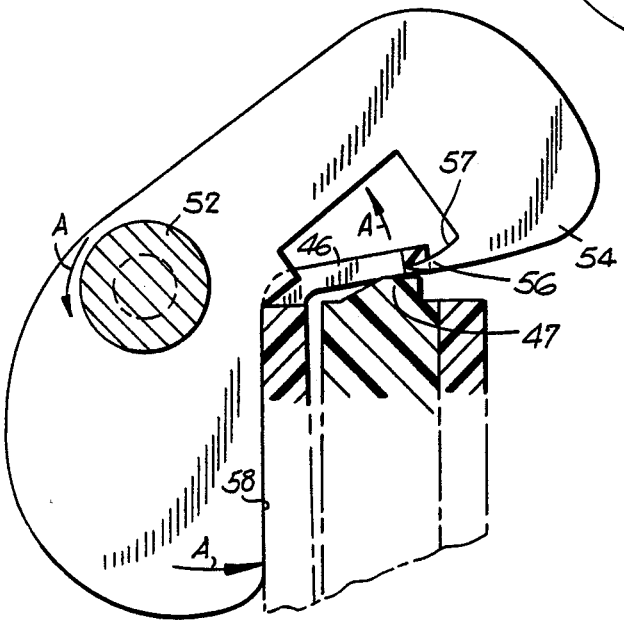
FIG. 7 is a further illustration of FIG. 6 and the operation of the cover removal tool illustrated therein.

Accordingly, reference is now made to FIGS. 3 and 5 through 7, wherein a cover removing tool, generally indicated at 50 is depicted. The cover removing tool includes a handle 51, a shaft 52 and a head 53 suitably mounted to shaft 52. As illustrated in FIGS. 6 and 7, head 52 includes a hook section 54 and a support section 55. The hook section 54 includes a pick 56 and a cutaway 57 that permits the pick 56 to be inserted under the closure loop 46. As is best illustrated in FIG. 6, support section 55 includes a leverage wall 58 which is disposed at an angle from the cover sufficient to permit a slight rotation of head 53 once the pick 56 is displaced under closure loop 46. As is more particularly illustrated in FIG. 7, by rotating the head 53 in the direction A, leverage wall 58 is brought into contact with the surface of the cover and the closure loop is resiliently biased by pick 56 out of engagement with projection 47 thereby permitting closure loop 46 and, hence, cover 21 to be released from the I-beam support 20. Accordingly, by utilizing cover removing tool 50, the covers can be readily replaceably secured on the I-beam support.

Reference is now made to FIG. 4 wherein a compliant contact replacement tool, generally indicated at 60, is depicted. Contact removal tool 60 includes a elongated body 61 having a knurled surface 62 for permitting the body to be easily held. Extending from the first end of body 61 is insertion prod 63. On the other end of body 61 is removal pin assembly 64. Insertion prod 63 includes neck 65 and head 66. Removal pin assembly 64 includes a projecting head 67 and three removal pins 68.

Reference is now made to FIGS. 10 through 13 wherein use of the compliant pin removal tool 60 is demonstrated in detail. When a compliant lead is damaged or nonfunctional, replacement thereof can be obtained by removing cover 21 from support 20 in the manner described above using the cover removal tool 50. Once cover 21 is removed, all of the compliant contacts are exposed for examination. After the defective compliant contact 22 is identified, the projecting pins 68 of tool 60 are inserted in the manner illustrated in FIG. 9 so that two of the projections fit within bends 26 formed in the distal end of the dual beams 25 and the remaining projection 68 is inserted within the space between dual beams 25. The tool then permits the compliant pin 22 to be pulled from the receiving slot in the direction B, in the manner illustrated in FIGS. 10 and 11.

Thereafter, a new and presumeably operative compliant contact can then be inserted into the receiving slot of I-beam support 20. However, in order to provide sufficient force to insert the compliant pin, the projecting head 67 is inserted into the opening between dual beams 25 and is forced against collar 24 of the compliant contact in the direction C illustrated in FIG. 13 until the compliant contact is fully inserted into the receiving slot. Once the damaged or nonfunctional compliant contacts have been replaced, cover 21 is then replaced on the I-beam support and the entire circuit board array is made fully operational.

As noted above, the compliant contacts are formed of spring steel and are well known in the art. The I-beam support and cover 21 are injection molded using conventional curable resins.

Accordingly, the interplane connector assembly of the instant invention is characterized by the ability to replace compliant contacts that have been damaged or are nonfunctional without having to replace the entire interplane connector. Also, after such replacement of a contact no loss of integrity in the housing-contact interface or functioning of the contact occurs. Moreover, this benefit is obtained without in any way reducing the ability of the circuit board arrays and interplane connectors to be assembled with mating forces on the order of 300 pounds.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An interplane connector assembly for releasably mounting and positioning a plurality of dual beam compliant contacts having a space formed between the dual beams and having a contact tail to be inserted into the opening of a printed circuit board, comprising support means for receiving therein at least one row of dual beam compliant contacts so that the contact tail extends from the support means, said support means defining a row of openings, each opening adapted to be disposed in alignment with the space formed by the dual beams of the compliant contact when the compliant contact is disposed in said support means, and cover means adapted to be releasably secured to the support means, said cover means including a row of stops projecting therefrom, said stops being adapted to pass through the space formed by each compliant contact and into said aligned opening in said support means when said cover means is releasably secured to said support means so that said compliant contacts are prevented from being displaced from said support means when mating forces are applied against said contacts, and so that each of said compliant contacts can be selectively removed from said support means.

2. An interplane connector assembly, as claimed in claim 1, wherein said support means includes a central support wall and a plurality of projecting walls for defining a plurality of receiving recesses aligned in a row, each of said receiving recesses being configured to receive a compliant contact therein, each recess having an opening formed therein so that said openings is in alignment with said space in said compliant contact when said compliant contact is disposed in said recess.

3. An interplane connector assembly, as claimed in claim 2, wherein said support means includes two end walls, each end wall including a projection integrally formed thereon, said cover means including a retaining means, said retaining means being adapted to be releaseably secured to a projection to permit said cover means to be releasably secured to said support means.

4. An interplane connector assembly, as claimed in claim 3, wherein said retaining means includes a resilient loop extending from each opposed end of said cover means, each said resilient loop being adapted to be snapped over said projection to mount said cover means to said support means.

5. An interplane connector assembly, as claimed in claim 4, wherein said projections include a camming surface, said camming surface facilitating the snapping of said loop over said projections.

6. An interplane connector assembly, as claimed in claim 3, and including cover plate removal means, said cover plate removal means being adapted to bend back said retaining means from said projection and hence permit said cover means to be removed from said support means without destroying said retaining means.

7. An interplane connector assembly, as claimed in claim 6, wherein said cover plate removal means includes a pick means adapted to be displaced under said retaining means and a leverage means disposed at an angle with respect to said cover means to permit a slight rotation of said pick means to bend back said retaining means.

8. An interplane connector assembly, as claimed in claim 1, and including compliant contact replacement means, said compliant contact replacement means having removal pins disposed at a first end thereof, said removal pins being adapted to releasably engage said dual beams and permit said compliant contact to be pulled from said support means.

9. An interplane connector assembly, as claimed in claim 8, wherein said compliant contact replacement means includes a head disposed at a first end thereof, said head being adapted to engage said compliant contact to facilitate the pushing of the contact into said support means.

10. An interplane connector assembly, as claimed in claim 9, wherein said compliant contact replacement means includes removal pins disposed at a second end thereof, said removal pins being adapted to releasably engage said dual beams and permit said compliant contact to be pulled from said support means.

11. An interplane connector assembly, as claimed in claim 1, wherein said cover means and said support means are formed by injection molding a curable resin.

12. A interplane connector assembly, as claimed in claim 1, wherein support means include an I-beam support for defining a first and second row of receiving means for receiving compliant contacts, said openings in said support means being disposed between adjacent receiving recesses in said first and second rows, and first and second cover means adapted to be releasably secured to said support means adjacent said first and second rows, respectively, to define an enclosed unitary interplane connector assembly.

13. An interplane connector assembly, as claimed in claim 12, wherein said row of stops projecting from each of said cover means includes a full stop and a half stop projecting from said full stop, said full stop being disposed in the space between said dual beams and said half stop projecting into said openings in said support means when said cover means are releasably secured to said support means.

14. An interplane connector assembly, as claimed in claim 13, wherein said half stops projecting from said first and second cover means and configured to mate with each other and fill said openings in said adjacent receiving recesses in said first and second rows to thereby further prevent forces applied against said contacts from removing said contacts from said receiving recesses.

* * * * *